US005528213A

United States Patent [19]

Kondo et al.

[11] Patent Number: 5,528,213

[45] Date of Patent: Jun. 18, 1996

[54] FUSE

[75] Inventors: Hiroki Kondo; Shigemitsu Inaba; Mitsuhiko Totsuka; Toshiharu Kudo, all of Shizuoka, Japan

[73] Assignee: Yazaki Corporation, Tokyo, Japan

[21] Appl. No.: 263,682

[22] Filed: Jun. 22, 1994

[30] Foreign Application Priority Data

Jun. 22, 1993 [JP] Japan ..... 5-173662

[51] Int. Cl.[6] ..... H01H 85/04

[52] U.S. Cl. ..... 337/160; 337/163; 337/164; 337/166

[58] Field of Search ..... 337/160, 163, 337/164, 166

[56] References Cited

U.S. PATENT DOCUMENTS

| | | | |
|---|---|---|---|
| 2,286,518 | 6/1942 | Taylor | 200/123 |
| 2,561,464 | 7/1951 | Cremer . | |
| 2,563,536 | 8/1951 | Laing | 200/123 |
| 2,683,788 | 7/1954 | Hoorn | 200/117 |
| 2,688,676 | 9/1954 | Laing | 200/123 |
| 2,727,109 | 12/1955 | Hoorn | 200/117 |
| 2,876,312 | 3/1959 | Frederick | 200/135 |
| 3,287,526 | 1/1966 | Brandt . | |
| 3,386,062 | 5/1968 | Kozaka | 337/160 |
| 4,357,588 | 11/1982 | Leach | 337/160 |
| 4,562,420 | 12/1985 | Kowalik | 337/165 |
| 4,751,490 | 6/1988 | Hatagishi | 337/295 |
| 4,944,084 | 7/1990 | Horibe | 337/160 |
| 4,958,426 | 9/1990 | Endo et al. | 29/623 |
| 4,994,779 | 2/1991 | Douglass | 337/163 |
| 5,262,751 | 11/1993 | Kudo | 337/296 |

FOREIGN PATENT DOCUMENTS

| | | | |
|---|---|---|---|
| 484725 | 7/1952 | Canada | 337/164 |
| 690991 | 7/1964 | Canada | 337/160 |
| 0039562 | 11/1981 | European Pat. Off. . | |
| 1135562 | 12/1965 | Germany . | |
| 1463733 | 3/1969 | Germany . | |
| 2217531 | 10/1989 | United Kingdom . | |
| WO9213356 | 6/1992 | WIPO . | |

*Primary Examiner*—Leo P. Picard
*Assistant Examiner*—Stephen T. Ryan
*Attorney, Agent, or Firm*—Sughrue, Mion, Zinn, Macpeak & Seas

[57] ABSTRACT

An embracing portion is formed on a fusible body of metal, and a chip of low-melting metal is embraced by this embracing portion, and a constricted portion of a small cross-sectional area is formed at the fusible body, and a radiating plate is provided in the vicinity of the constricted portion.

8 Claims, 6 Drawing Sheets

FUSE

BACKGROUND OF THE INVENTION

1. Field of the Invention

This invention relates to a fuse used in an automobile or the like for protecting a load circuit against an excess current.

2. Related Art

Fuses made of a copper alloy or the like have heretofore been used for protecting an excess current-flowing circuit such as a motor load circuit in an automobile and also for protecting a circuit when a large burst current due to a rare short circuit is produced. Usually, such a fuse has been provided in the form of a terminal with a fuse in which the fuse is formed integrally with a terminal portion, or in the form of a terminal with a fuse in which a fuse element is bonded to a terminal portion.

FIG. 6 is an exploded, perspective view of one example of such a conventional terminal with a fuse, in which a fuse element is bonded to a terminal portion.

In this Figure, the terminal 100 with a fuse comprises the fuse element 101, the terminal portion 102 comprising a pair of contact portions 102A each having a fuse element connection portion 102B formed at an upper end thereof, and a housing 103. Opposite ends of the fuse element 101 are bonded respectively to the two fuse element connection portions 102B of the terminal portion 102, and the fuse element 101 and the terminal portion 102 thus connected together are housed in the housing 103 of a synthetic resin or the like.

A cover 104 made of a transparent resin is removably attached to an upper end of the housing 103 for preventing dust and the like from intruding into the housing and for enabling the fusion of the fuse to be viewed with the eyes from the exterior.

A pair of mating terminals (not shown) connected to a load circuit are fitted in and connected to the pair of contact portions 102A, respectively, so that current flows into one contact portion 102A, flows through the fuse element 101, and then flows out of the other contact portion 102A. At this time, if an excess current larger than an operating current flows as a result of the occurrence of some abnormality, the temperature of the fuse element 101 is raised by the generation of Joule heat proportional to the product of the square of a current density and a resistance value, and when this exceeds a predetermined temperature, the fuse element 101 is fused to break the circuit.

Three kinds of fuse elements heretofore used will now be described with reference to FIGS. 7 to 9, respectively.

FIG. 7(*a*) is a top plan view of a fuse element 51, and the fuse element 51 comprises a fusible body 52 part of which is a constricted portion 53, and connection ends 54 formed at opposite ends of this fusible body, respectively. The connection ends 54 are connected to the fuse element connection portions 102B of FIG. 6, respectively. Since the cross-sectional area of the constricted portion 53 is smaller than that of the remainder of the fusible body 52, a current density of the constricted portion 53 is higher than that of the remainder of the fusible body 52, and therefore the constricted portion 53 can be fused easily (see Japanese Patent Unexamined Publication No. 60-127630).

As shown in a fusion characteristics diagram of FIG. 7(*b*), as compared with ideal fusion characteristics 55, the time required for fusion of a fuse element 57 with no constricted portion is longer, whereas a fuse element 56 with the constricted portion is advantageously getting close to the ideal characteristics 55 at a region of high current. Therefore, if a target fusion region 58 is that of large current, the fusion is effectively carried out.

FIG. 8(*a*) is a perspective view of a fuse element of another construction. This fuse element 61 comprises a fusible body 62 having a chip 63 of low-melting metal embraced by part thereof, and connection ends 64 formed at opposite ends of this fusible body, respectively (see Japanese Utility Model Unexamined Publication No. 59-66844).

When the temperature of the fusible body 62 reaches a melting point of the chip 63, the embraced chip 63 melts to form, together with the fusible body 62 of metal, an eutectic alloy. A melting point of this alloy is lower than that of the original fusible body 62, and therefore this enables the fusible body to be fused in a short time.

As shown in a fusion characteristics diagram of FIG. 8(*b*), when an excess current is relatively small, the time required for fusion of a fuse element 67 with no chip is longer as compared with ideal fusion characteristics 65, whereas a fuse element 66 with the chip is advantageously getting close to the ideal characteristics 65 at a region of low current. Therefore, if a target fusion region 68 is that of low current, the fusion is effectively carried out.

FIG. 9(*a*) is a perspective view of a fuse element of a further construction. In this Figure, the fuse element 71 has a fusion portion 73 of a smaller cross-sectional area at a portion thereof, and two heat-radiating plates 72 with a larger radiating area are provided respectively at opposite ends of the fusion portion, and connection ends 74 are provided outwardly of the two radiating plates 72, respectively (see Japanese Utility Model Unexamined Publication No. 61-11258).

The fusion portion 73 has a small cross-sectional area, and therefore a current density of this portion is high, and hence the temperature of this portion can be easily raised as described above; however, the radiating plates 72 disposed adjacent thereto perform a radiating effect to alleviate the temperature rise, thus adjusting a time period before the fusion takes place.

As shown in a fusion characteristics diagram of FIG. 9(*b*), when an excess current is at a medium current region, the time required for fusion of a fuse element 77 with no radiating plate is shorter as compared with ideal fusion characteristics 75, whereas a fuse element 76 with the radiating plates has features that the time required for fusion is relatively long, and that it is getting close to the ideal characteristics 75 at a region of low current. Therefore, if a target fusion region 78 is that of medium current, a desired fusion time is achieved.

Although the conventional fuses are effective if the region of use is specified as described above, the following problems have been encountered when the region of use is wide:

The fuse element with the constricted portion shown in FIG. 7 is reduced in cross-sectional area so that it can be instantaneously fused by an excess current such as a burst current, as described above. As a result, it has a disadvantage that even if the excess current is at a medium current region, the fuse element can be fused in a relatively short time.

In this case, even if a medium current slightly exceeding a stationary current flows as an excess current even for a short period of time immediately after the operation is started as in a motor load circuit of an automobile, the fuse is fused, thus inviting a problem that the starting operation is quite inconvenient.

In the fuse element with the chip shown in FIG. 8, a time delay is encountered before the chip 63 of low-melting metal is fused, and therefore there has been encountered a problem that the fuse element can not be easily fused if an excess current is a large current such as a burst current.

In the fuse element with the radiating plates shown in FIG. 9, if an excess current is at a low current region, the radiating effect by the radiating plates becomes a reverse effect to prevent a temperature rise of the fuse portion 73, which results in a drawback that the fusion is not achieved within a desired time period.

In this case, if a low current, that is, a minimum operating current for fusing the fuse or a current close to it, is caused to flow as an excess current for a long period of time, the whole of the terminal with the fuse is maintained at high temperature for a relatively long period of time before the fuse is raised in temperature to be fused, and therefore there is encountered a problem that neighboring case and cover are melted.

SUMMARY OF THE INVENTION

The present invention has been made in order to solve the above drawbacks and problems of the conventonal art, and an object of the invention is to provide a fuse which, even if an excess current is produced at any one of a large current region, a medium current region and a low current region, can be fused within a respective one of predetermined time periods.

To achieve the above object, the present invention provides a fuse characterized in that a constricted portion of a small cross-sectional area is formed at a fusible body of metal having a chip of low-melting metal embraced by an embracing portion thereof; and a radiating plate is provided in the vicinity of the constricted portion of the fusible body.

The above construction is further characterized in that the embracing portion, the constricted portion and the radiating plate are integrally formed.

The above construction is further characterized in that the embracing portion, the constricted portion and the radiating plate are integrally formed with a terminal portion.

In the fuse of the above construction, the chip of low-melting metal embraced by the embracing portion is melted by an excess current of a low current region, and cooperates with the fusible body of metal to form a low-melting eutectic alloy, and therefore the fuse is fused at low temperatures in a relatively short time. The constricted portion of a small cross-sectional area formed at the fusible body is instantaneously fused by an excess current of a large current region. The radiating plate, provided in the vicinity of the constricted portion of the fusible portion, alleviates the temperature rise of the constricted portion, caused by an excess current of a medium current region, through heat radiation, thereby prolonging the fusion time for the medium current.

BRIEF DESCRIPTION OF THE DRAWINGS

FIG. 7(*b*) is a diagram showing fusion characteristics of the conventional fuse element;

FIG. 8(*b*) is a diagram showing fusion characteristics of said another conventional fuse element;

FIG. 9(*b*) is a diagram showing fusion characteristics of said further conventional fuse element.

DETAILED DESCRIPTION OF THE PREFERRED EMBODIMENTS

A first embodiment of the present invention will now be described with reference to FIGS. 1 to 4.

Figure 3:
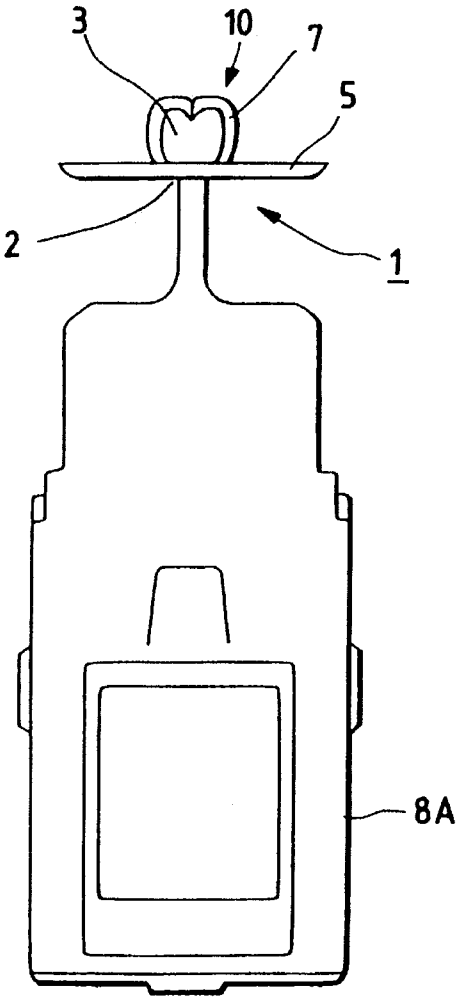
FIG. 3 is a side-elevational view of the terminal with the fuse of FIG. 1.
Figure 2:
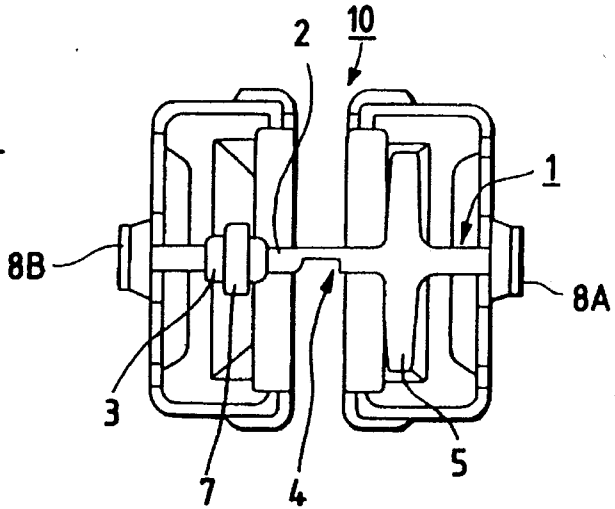
FIG. 2 is a top plan view of the terminal with the fuse of FIG. 1.
Figure 1:
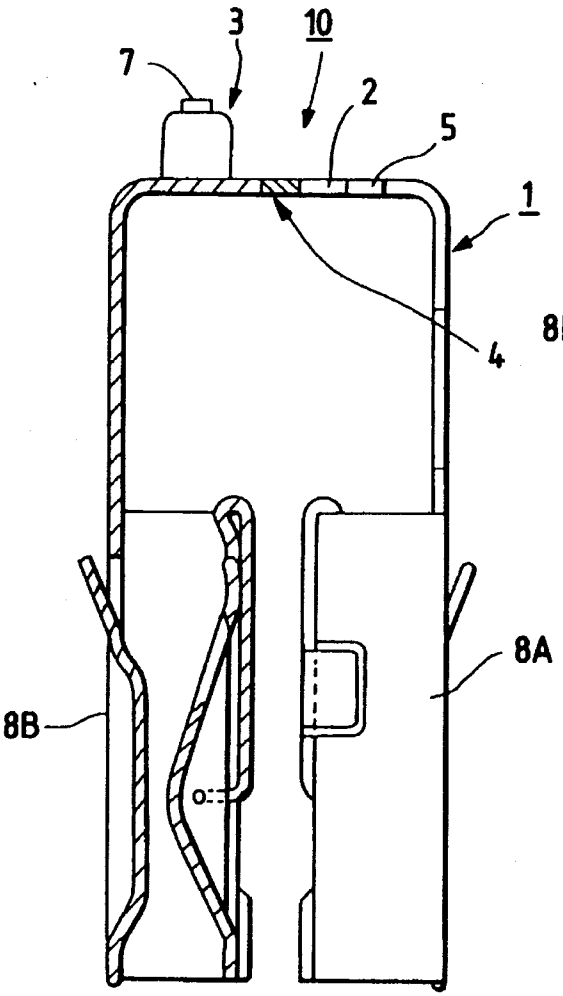
FIG. 1 is a front-elevational view of a terminal with a fuse of the present invention.

FIG. 1 is a partly cross-sectional, front-elevational view of a terminal 10 with a fuse of the present invention, FIG. 2 is a top plan view of the terminal of FIG. 1, and FIG. 3 is a side-elevational view of the terminal of FIG. 1.

In FIG. 1, the fuse 1 has a pair of terminal portions 8A and 8B formed integrally at opposite bent ends thereof, respectively, and the fuse 1 and the pair of terminal portions 8A and 8B are formed by stamping a single electrically-conductive metal plate and by bending it.

The fuse 1 comprises a fusible body 2 which includes a portion embracing a chip 3 of low-melting metal, a constricted portion 4 smaller in cross-sectional area than its neighboring portions, and a heat-radiating plate 5.

In this Figure, that portion from the terminal portion 8B to the constricted portion 4 (that is, to a generally central portion of the fusible body 2) is shown in cross-section.

In this embodiment, a Sn chip is used as the low-melting metal.

A pair of mating connection terminals (not shown) connected to a load circuit are fitted in and connected to the pair of terminal portions 8A and 8B, respectively. Therefore, current flows into one of the terminal portions (for example, the terminal portion 8B), and flows upwardly through a left lower end of the fuse 1 into the fusible body 2, and flows through the chip embracing portion 7 and the constricted portion 4, and flows across the radiating plate 5 away from the fusible body 2, and flows downwardly into a right lower end of the fuse 1, and flows out of the other terminal portion 8A.

At this time, if an excess current larger than an operating current flows for some reason, the temperature of the fusible body 2 is raised by the generation of Joule heat proportional to the product of the square of a current density and a resistance value, and when this exceeds a predetermined temperature, that portion is fused to thereby break the circuit.

The fusible body 2 of the fuse 1 will now be described with reference to FIGS. 2 and 3.

The fusible body 2 has the constricted portion 4 formed at a generally central portion thereof by providing a notch. The cross-sectional area of the constricted portion 4 is smaller than that of those portions of the fusible body 2 disposed adjacent to and on opposite (right and left) sides of the constricted portion 4. Therefore, the current density of the constricted portion 4 is higher than that of its neighboring portions of the fusible body 2.

The Joule heat generated at the constricted portion 4 is partly used for raising the temperature of this constricted portion, and is partly radiated to the radiating plate 5, and is partly absorbed by the chip 3 embraced by the embracing portion 7.

If the excess current is a large current which rises quickly, the rate of heat transfer and the rate of thermal diffusion do not catch up with the temperature rise of the constricted portion 4, so that the constricted portion 4 is instantaneously fused before the radiating effect occurs.

If the excess current flowing through the constricted portion 4 is a medium current, the rate of the temperature rise of the constricted portion 4 is alleviated by the heat transfer and thermal diffusion effects, and a time period before the fusion of the constricted portion 4 occurs is made longer. Therefore, if the excess current is a transient current of a medium magnitude, the cross-sectional area of the constricted portion 4, the radiating area of the radiating plate 5 and etc., are so determined that the excess current can disappear before the fusion temperature is achieved.

Next, if the excess current is a low current slightly exceeding an allowable value, the radiating effect of the radiating plate 5 and the heat-absorbing effect of the chip 3 for the amount of heat generated from the constricted portion 4 become greater, so that the temperature rise of the constricted portion 4 becomes gentle, and therefore the fusion can not take place easily. As a result, the current continues to flow for a long period of time, and if this condition is maintained, the temperature of the terminal portions 8A and 8B rises enough to melt a housing of a resin. This is undesirable.

In such a case, the chip 3 achieves an effect. More specifically, the chip 3 of low-melting metal melts and reacts with the fusible body 2 to form a low-melting eutectic alloy. As a result, the thus formed eutectic portion of the fusible body is fused at relatively low temperatures, thereby interrupting the excess current.

Figure 4:
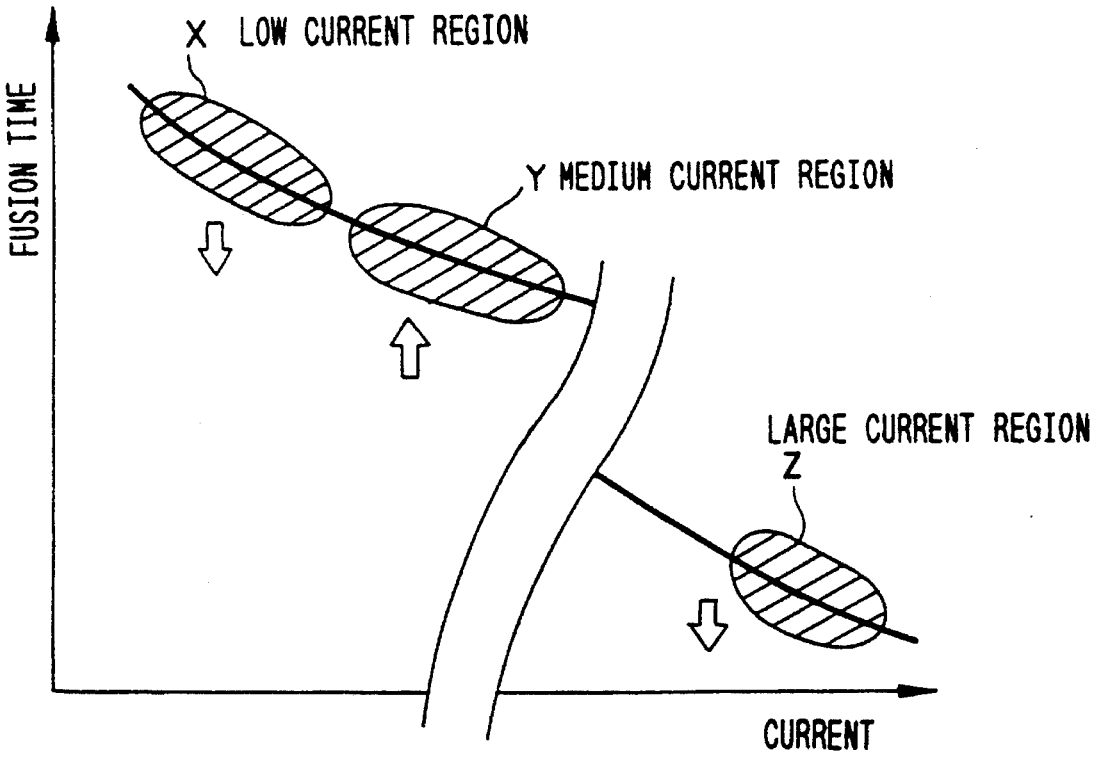
FIG. 4 is a diagram showing fusion characteristics of the fuse of the present invention.

FIG. 4 show fusion characteristics of the fuse of the present invention.

In the fuse of the present invention, the cross-sectional area of the constricted portion is sufficiently small as described above, and therefore when a large excess current due to a rare short circuit or the like flows, the constricted portion is positively fused before the load is broken or before lead wires connected to the load are fused, thereby positively breaking the circuit. Namely, with the construction of the present invention, the fusion time at a large current fusion region Z is shortened (that is, it is shifted in a direction of a downwardly-directed arrow in the Figure).

At a medium current fusion region Y in the Figure, the heat generated by the constricted portion is radiated by the radiating plate, and besides if the embracing portion is provided in the vicinity of the constricted portion, part of the heat is absorbed by the chip and other portions. Therefore, the fusion time can be prolonged so that the circuit may not be broken by a transient excess current of a medium magnitude produced during the operation. Namely, with the construction of the present invention, the fusion time at the medium current fusion region Y can be prolonged (that is, it is shifted in a direction of an upwardly-directed arrow in the Figure).

At a low current fusion region X in the Figure, if a minimum operating current or a current close to it is caused to flow for a long period of time, the eutectic alloy is formed as a result of fusion of the chip, and the eutectic portion of the fusible body is fused at relatively low temperatures. Therefore, there is no fear that a case and a case cover will be melted. Namely, with the construction of the present invention, the fusion time at the low current fusion region X is shortened (that is, it is shifted in a direction of a downwardly-directed arrow in the Figure).

As is clear from the foregoing, in the fuse of the present invention, when a large current is produced, the fuse is positively fused to thereby break the circuit, and when a transient medium current is produced during the operation, the fusion time is prolonged to thereby avoid an unnecessary breakage of the circuit, and further when a low current such as a minimum operating current is accidentally caused to flow for a long period of time, the fuse is fused at relatively low temperatures to thereby avoid an accident that the case and the case cover are melted. Thus, effective characteristics are achieved at a time for various kinds of excess currents.

Figure 5:
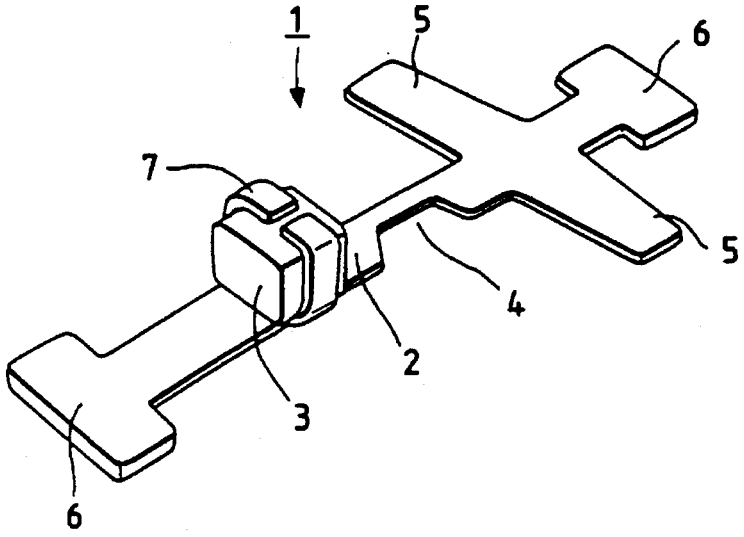
FIG. 5 is a perspective view of another embodiment of a fuse of the present invention.
Figure 6:
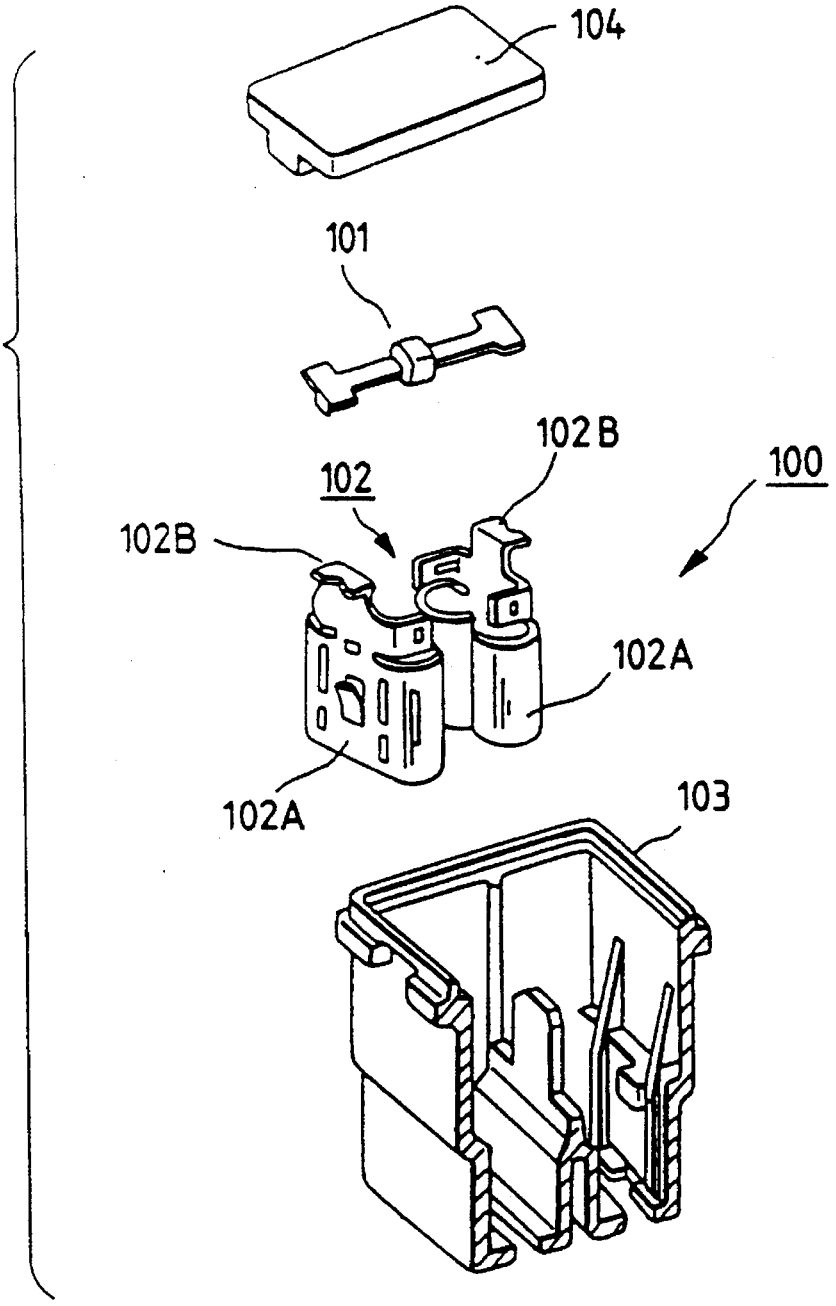
PRIOR ART FIG. 6
FIG. 6 is an exploded, perspective view of a terminal with a conventional fuse.
Figure 7A:
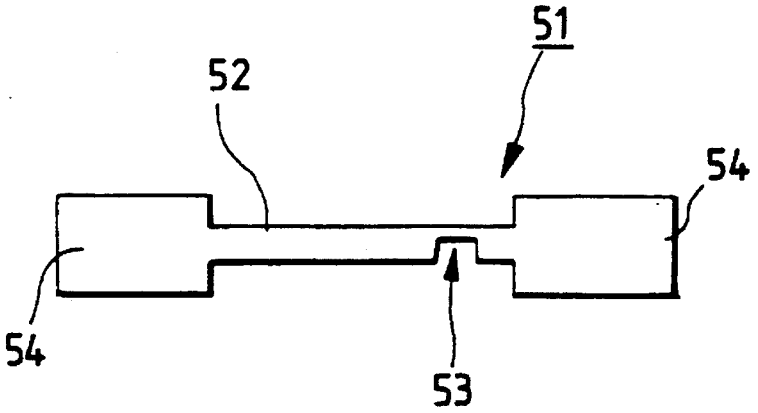
FIG. 7(*a*) is a top plan view of a conventional fuse element.
Figure 7B:
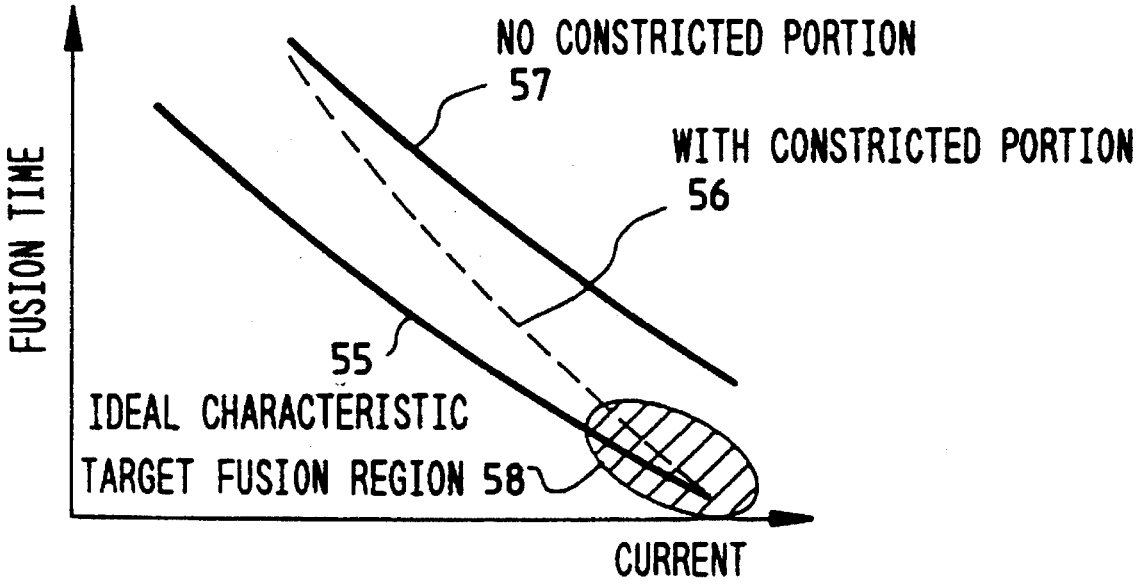
Figure 8A:
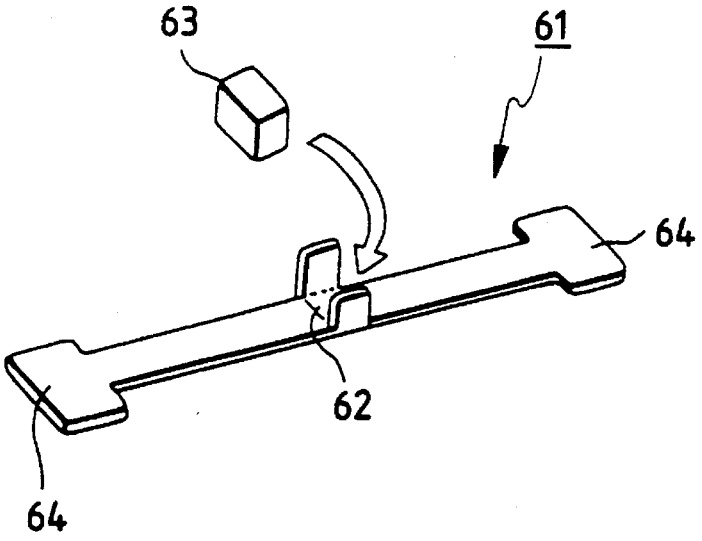
FIG. 8(*a*) is a top plan view of another conventional fuse element.
Figure 8B:
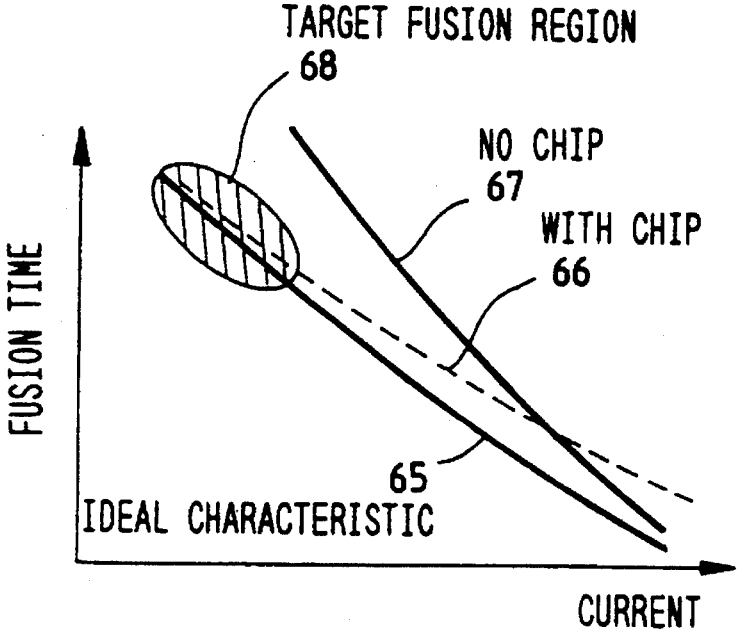
Figure 9A:
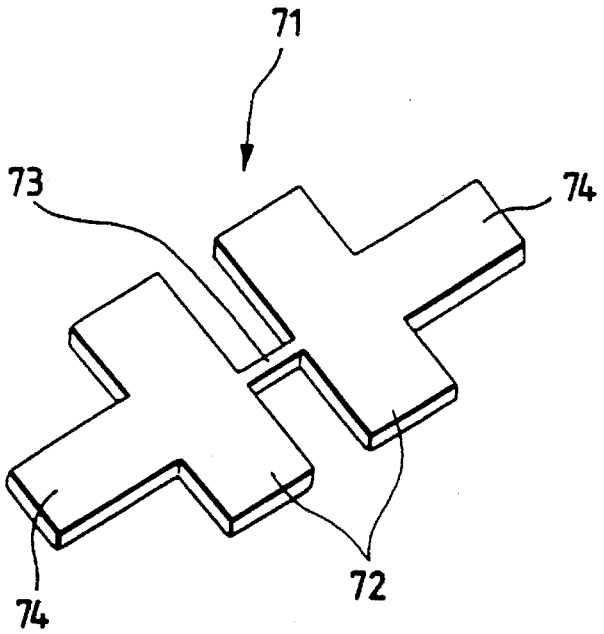
FIG. 9(*a*) is a top plan view of a further conventional fuse element.
Figure 9B:
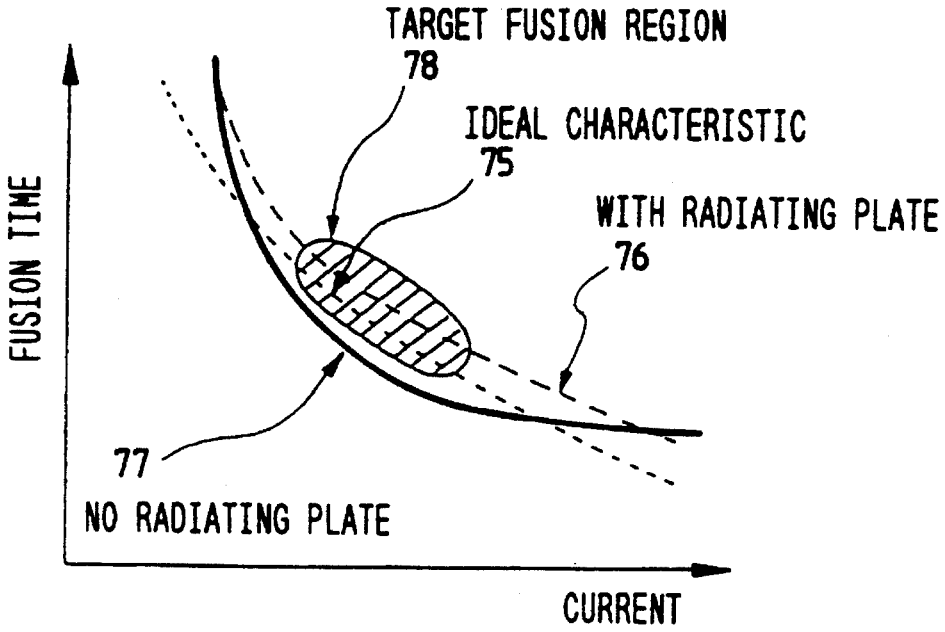

FIG. 5 is a perspective view of another preferred embodiment of a fuse of the present invention. In this Figure, a fuse 1 comprises a fusible body 2 which includes an embracing portion 7 embracing a chip 3, a constricted portion 4 disposed adjacent to the embracing portion 7, and a heat-radiating plate 5 disposed adjacent to the constricted portion 4. The fuse 1 also includes connection terminals 6 formed respectively at opposite ends of the fusible body 2. In use, this fuse is connected, for example, to the fuse element connection portions 102B of the terminal portion 102 in FIG. 6 showing the conventional art. The fuse 1 is formed into an integral construction as by stamping from a metal sheet. Fusion characteristics of this fuse 1 are generally similar to those of FIG. 4.

In each of the above embodiments, the constricted portion is provided at the generally central portion of the fusible body, and the chip and the radiating plate are disposed respectively on the opposite sides of this constricted portion in such a manner that the constricted portion is interposed therebetween; however, other construction than the above arrangement can be adopted for overcoming the problems to be solved by the present invention. However, if other arrangement than those of the above embodiments is adopted, the temperature distribution of the fusible body is affected, so that fusion characteristics are degraded.

Namely, for example, let's assume that the constricted portion is provided at a generally central portion of the fusible body, and that the chip and the radiating plate are provided in this order on one side of the constricted portion. In this case, when a transient medium current flows to cause the constricted portion to generate heat, the effect of the radiating plate is not achieved since the radiating plate is remote from the constricted portion, and as a result the fuse is fused.

Also, let's assume that the radiating plate and the chip are provided in this order on one side of the constricted portion formed on the fusible body. In this case, when a minimum operating current or a current close to it flows for a long period of time to heat the constricted portion, this heat is transferred to the chip in such a manner that this heat is suppressed by the radiating plate. As a result, the intended effect of the chip to shorten the fusion time is lowered.

Therefore, it is most effective to adopt the arrangement of the above embodiments in which the constricted portion is provided at the central portion, and the chip and the radiating plate are provided respectively on the opposite sides of the constricted portion.

In each of the above embodiments, although a set of the constricted portion, chip and radiating plate are provided, a plurality of sets of these portions can be provided on the fusible body so as to enhance a fusion sensitivity of the fuse.

As described above, in the fuse of the present invention, the constricted portion of a small cross-sectional area is formed at the fusible body of metal having the chip of low-melting metal embraced by the embracing portion thereof, and the radiating plate is provided in the vicinity of the constricted portion of the fusible body. With this construction, the chip of low-melting metal is melted by the excess current of the low current region, and cooperates with the fusible body of metal to form the low-melting alloy, so that the fuse is fused at low temperatures in a relatively short time. Therefore, even if the minimum operating current or a current close to it is caused to flow for a long period of time, the whole of the terminal with the fuse is prevented from being maintained at high temperatures for a relatively long period of time before the fuse is heated and fused, thereby solving the problem that the neighboring case and cover are melted.

On the other hand, the constricted portion of a small cross-sectional area formed at the fusible body is instantaneously fused by the excess current of the large current region, and therefore damage to the load circuit by a large current flowing thereinto can be prevented.

The radiating plate provided in the vicinity of the constricted portion of the fusible body alleviates the temperature rise of the constricted portion due to the excess current of the medium current region, so that the fusion time at the medium current region is prolonged. Therefore, when a medium current slightly exceeding a stationary current flows as an excess current for a short period of time immediately after the operation is started as in a motor load circuit of an automobile, the fuse will not be fused, thereby enabling a smooth start of the operation.

What is claimed is:

1. A fuse element comprising:

a fusible body comprising a single electrically conductive metal plate of uniform thickness, including:

a constricted portion with a cross-sectional area smaller than a cross-sectional area of the fusible body;

an embracing portion for embracing a chip of low-melting metal therein, wherein said embracing portion comprises one or more arms which protrude from said fusible body to embrace the chip said embracing portion positioned to one side of said constricted portion; and a radiating plate having a cross-sectional area larger than the cross-sectional area of said fusible body for performing a radiating effect, wherein said constricted portion is disposed between said embracing portion and said radiating plate.

2. A fuse element as claimed in claim 1, wherein the constricted portion is fused at a first predetermined current.

3. A fuse element as claimed in claim 2, wherein the embracing portion is fused at a second predetermined current lower than the first predetermined current after a predetermined time period.

4. A fuse element as claimed in claim 3, wherein the radiating plate alleviates a temperature rise of the constricted portion to prolong a fusion time of the fuse element at a third predetermined current lower than the first predetermined current and higher than the second predetermined current.

5. A fuse element as claimed in claim 1, wherein said embracing portion, said constricted portion and said radiating plate are integrally formed.

6. A fuse element as claimed in claim 1, further comprising:

a pair of terminal portions, wherein said embracing portion, said constricted portion and said radiating plate are integrally formed with the pair of terminal portions.

7. A fuse element as claimed in claim 1, further comprising:

a pair of terminal portions, each of said terminal portions having a fuse element connection portion at an upper end thereof for connecting said terminal portions with said fusible body.

8. A fuse element as claimed in claim 1, wherein a longitudinal axis of said radiating plate is substantially transverse to a longitudinal axis of said fusible body.

* * * * *